US007614859B2

(12) United States Patent
Sawai et al.

(10) Patent No.: US 7,614,859 B2
(45) Date of Patent: Nov. 10, 2009

(54) SCROLL COMPRESSOR WITH CERTAIN PRESSURE RATIO BETWEEN DISCHARGE PRESSURE AND SUCTION PRESSURE AND WITH CERTAIN RATIO OF DIAMETER OF ORBITING MIRROR PLATE AND OUTER DIAMETER OF THE ANNULAR SEAL

(75) Inventors: Kiyoshi Sawai, Shiga (JP); Noboru Iida, Shiga (JP); Yoshiyuki Futagami, Shiga (JP); Akira Hiwata, Kyoto (JP); Teruyuki Akazawa, Shiga (JP)

(73) Assignee: Matsushita Electric Industrial Co., Ltd., Kadoma-Shi (JP)

( * ) Notice: Subject to any disclaimer, the term of this patent is extended or adjusted under 35 U.S.C. 154(b) by 124 days.

(21) Appl. No.: 10/560,037

(22) PCT Filed: Jun. 9, 2004

(86) PCT No.: PCT/JP2004/008373

§ 371 (c)(1),
(2), (4) Date: Feb. 5, 2007

(87) PCT Pub. No.: WO2004/111456

PCT Pub. Date: Dec. 23, 2004

(65) Prior Publication Data

US 2008/0038133 A1 Feb. 14, 2008

(30) Foreign Application Priority Data

Jun. 12, 2003 (JP) ..... 2003-168215

(51) Int. Cl.
*F01C 1/02* (2006.01)
*F03C 2/00* (2006.01)
*F04C 18/00* (2006.01)

(52) U.S. Cl. ..... 418/55.1; 418/55.4; 418/55.5; 418/57

(58) Field of Classification Search ..... 418/55.1–57, 418/270, DIG. 1

See application file for complete search history.

(56) References Cited

U.S. PATENT DOCUMENTS 4,861,245 A 8/1989 Tojo et al.
6,318,982 B1 * 11/2001 Fujii et al. ..... 418/55.5

FOREIGN PATENT DOCUMENTS

| | | | |
|---|---|---|---|
| CN | 1386982 A | | 12/2002 |
| CN | 1420965 A | | 5/2003 |
| JP | 57-70984 | | 5/1982 |
| JP | 60-128992 | | 7/1985 |
| JP | 7-119652 | | 5/1995 |
| JP | 2000136782 A | * | 5/2000 |
| JP | 2000-283066 | | 10/2000 |
| JP | 2001-280252 | | 10/2001 |
| JP | 2001280252 A | * | 10/2001 |
| JP | 2003-35286 | | 2/2003 |
| WO | WO 2002/063171 A1 | | 8/2002 |

OTHER PUBLICATIONS

Office Action dated Nov. 9, 2007 corresponding to Chinese patent application No. 200480020056.8 with English language translation.

* cited by examiner

*Primary Examiner*—Theresa Trieu
(74) *Attorney, Agent, or Firm*—Kratz, Quintos & Hanson, LLP

(57) ABSTRACT

A back pressure chamber (12) provided on a back surface of an orbiting scroll (5) is divided into an inner region (12*a*) and an outer region (12*b*) by an annular seal (11). A diameter d of the annular seal (11) is set 0.5 times or more of a diameter D of an orbiting mirror plate (5*a*). With this, plus thrust force can be applied to the orbiting scroll (5) irrespective of magnitude of a discharge pressure Pd applied to the inner region (12*a*). Therefore, it is possible to push the orbiting scroll (5) against the fixed scroll (4) only by back pressure of discharge pressure. A set pressure Pm of the outer region (12*b*) is reduced to a value close to a suction pressure Ps, a pressure adjusting mechanism (20) is swiftly opened after a scroll compressor is started. With this, lubricant oil is supplied from the outer region (12*b*) to the suction space (9) without a time lag.

6 Claims, 4 Drawing Sheets

SCROLL COMPRESSOR WITH CERTAIN PRESSURE RATIO BETWEEN DISCHARGE PRESSURE AND SUCTION PRESSURE AND WITH CERTAIN RATIO OF DIAMETER OF ORBITING MIRROR PLATE AND OUTER DIAMETER OF THE ANNULAR SEAL

TECHNICAL FIELD

The present invention relates to a scroll compressor used for a refrigeration cycle apparatus, and more particularly, to a scroll compressor suitable for a vapor-compression refrigeration cycle using R410A, carbon dioxide ($CO_2$) and the like as a refrigerant.

BACKGROUND TECHNIQUE

In the conventional scroll compressor of this kind, to reduce leakage loss in a compressed chamber and to obtain high efficiency, an orbiting scroll is brought into contact and slide with a fixed scroll, and the compressed chamber is sealed in many cases. FIG. 5 shows an example of a conventional structure described in patent document 1 (Japanese Patent Application Laid-open No. 2001-280252). That is, in the conventional scroll compressor, a back pressure chamber 12 is provided on a surface on the opposite side (back surface) from an orbiting scroll wrap surface of an orbiting scroll 5. The back pressure chamber 12 is divided into an inner region 12*a* and an outer region 12*b* by an annular seal 11. Lubricant oil in a discharge pressure state is supplied to the inner region 12*a* of the annular seal 11, a portion of this lubricant oil is supplied to the outer region 12*b* through a narrowed portion 13, and the lubricant oil of the outer region 12*b* is supplied to a suction space 9. With this configuration, the outer region 12*b* is set to an intermediate pressure Pm between a suction pressure Ps and a discharge pressure Pd, thrust force is applied to a back surface of the orbiting scroll 5, thereby allowing the orbiting scroll 5 to come into contact and slide with a fixed scroll 4.

According to the above structure, when the scroll compressor is started, lubricant oil is first supplied to the inner space 12*a* of the annular seal 11 and then, is supplied to the outer space 12*b*, but lubricant oil is not supplied to the suction space 9 formed by both the scroll until the pressure in the outer space 12*b* becomes equal to the set intermediate pressure Pm (=Ps+ΔP). When lubricant oil is not supplied to the suction space 9 at the time of starting of the scroll compressor, if a large amount of refrigerant liquid is returned to the suction space 9 from the refrigeration cycle together with refrigerant gas, there is a problem that lubricant oil remaining on a sliding surface is washed away and as a result, and the fixed scroll 4 or the orbiting scroll 5 is damaged and seized up.

Especially when the refrigerant has high pressure like carbon dioxide ($CO_2$), an absolute value of thrust force which pushes the orbiting scroll 5 against the fixed scroll 4 becomes high, and an absolute value of a set back pressure ΔP (=Pm−Ps) also becomes high. Therefore, a duration of lubrication delay becomes longer as compared with refrigerant R410A and thus, there is a problem that the fixed scroll 4 and orbiting scroll 5 are more prone to be seized up.

Hence, it is an object of the present invention to provide a reliable scroll compressor capable of preventing lubrication delay at the time of start of the scroll compressor.

DISCLOSURE OF THE INVENTION

A first aspect of the present invention provides a scroll compressor wherein a fixed scroll having a fixed scroll wrap on a fixed mirror plate and an orbiting scroll having an orbiting scroll wrap on an orbiting mirror plate are combined with each other to form a plurality of compressed chambers, a back pressure chamber is provided on a surface on the opposite side from the orbiting scroll wrap surface of the orbiting scroll, the back pressure chamber is divided by an annular seal into an inner region and an outer region, a lubricant oil in a discharge pressure state is supplied to the inner region of the annular seal, a portion of the lubricant oil is decompressed at a narrowed portion and supplied to the outer region, the lubricant oil in the outer region is supplied to a suction space, pressure in the outer region is set to a predetermined pressure Pm between a suction pressure Ps and a discharge pressure Pd, thrust force is applied to a back surface of the orbiting scroll, thereby bringing the orbiting scroll into contact with the fixed scroll, rotation of the orbiting scroll is restrained by a rotation-restraint member, the orbiting scroll is allowed to orbit, thereby moving the compressed chamber toward a center of scroll while reducing its volume, refrigerant gas is sucked into the compressed chamber and compressed, a ratio (d/D) of a diameter D of the orbiting mirror plate of the orbiting scroll and an outer diameter d of the annular seal is set greater than 0.5.

With this aspect, if the ratio (d/D) is set greater than 0.5, even if the magnitude of discharge pressure is varied due to the operation condition, plus (+) thrust force can always be obtained. Therefore, it is possible to bring the orbiting scroll into contact and slide with the fixed scroll only by the discharge pressure Pd applied to the inner region of the annular seal. With this, the pressure Pm applied to the outer region of the annular seal can be set to the same value as the suction pressure Ps or a value close to the suction pressure Ps. As a result, when the compressor is started, lubricant oil supplied to the outer region of the annular seal is supplied to the suction space substantially simultaneously. Therefore, the supply delay of lubricant oil is eliminated, and even if refrigerant liquid is sucked into the suction space from the initial stage of the start, the sliding surface is not seized up.

According to a second aspect of the invention, in the scroll compressor of the first aspect, a back pressure ΔP (=Pm−Ps) applied to the outer region divided by the annular seal is set such that a ratio (ΔP/Po) of the back pressure ΔP and a saturation vapor pressure Po when the refrigerant gas is at 0° C. is substantially a constant value and 0.2 or lower.

According to this aspect, if the lubricant oil flows from the inner region of the annular seal into the outer region, the pressure Pm in the outer region rises. If the set pressure Pm is low pressure (i.e., suction pressure Ps or pressure close to the suction pressure Ps), the pressure reaches such a value within a short time. Therefore, the pressure is set to 0.2((P/Po(0, i.e., Ps+0.2(Po(Pm(Ps using the saturation vapor pressure Po (constant value) when a refrigerant to be used is at 0(C. By setting the set back pressure of the outer region small in this manner, the pressure in the outer region of the annular seal reaches the set value within a short time and then, lubricant oil is also supplied to the suction space of the compressor mechanism swiftly. Thus, the supply delay of the lubricant oil to the suction space is reduced. Even if refrigerant liquid is sucked into the suction space from the initial stage of start, the sliding surfaces are not seized up.

According to a third aspect of the invention, in the scroll compressor of the first or second aspect, the refrigerant gas sucked into the suction space includes liquid refrigerant having dryness parameter of 0.5 or less.

According to this aspect, even when refrigerant gas including liquid refrigerant is sucked at the time of start, lubricant oil can be supplied swiftly at the time of start if dryness parameter of the refrigerant gas is 0.5 or less. With this, the reliability of the scroll compressor can be secured.

According to a fourth aspect, in the scroll compressor of the first or second aspect, carbon dioxide is used as the refrigerant.

According to this aspect, when CO2 is used as the refrigerant, since its pressure is high, thrust force for pushing the orbiting scroll against the fixed scroll is increased and the sliding surfaces are prone to be seizured correspondingly. However, if the back pressure (P in the outer region is set small, the back pressure rises to the set value within a short time, the lubricant oil is swiftly supplied to the suction space thereafter, and it is possible to prevent the sliding surfaces from being seizured.

BEST MODE FOR CARRYING OUT THE INVENTION

Embodiments of the present invention will be explained with reference to the drawings.

First Embodiment

Figure 1:
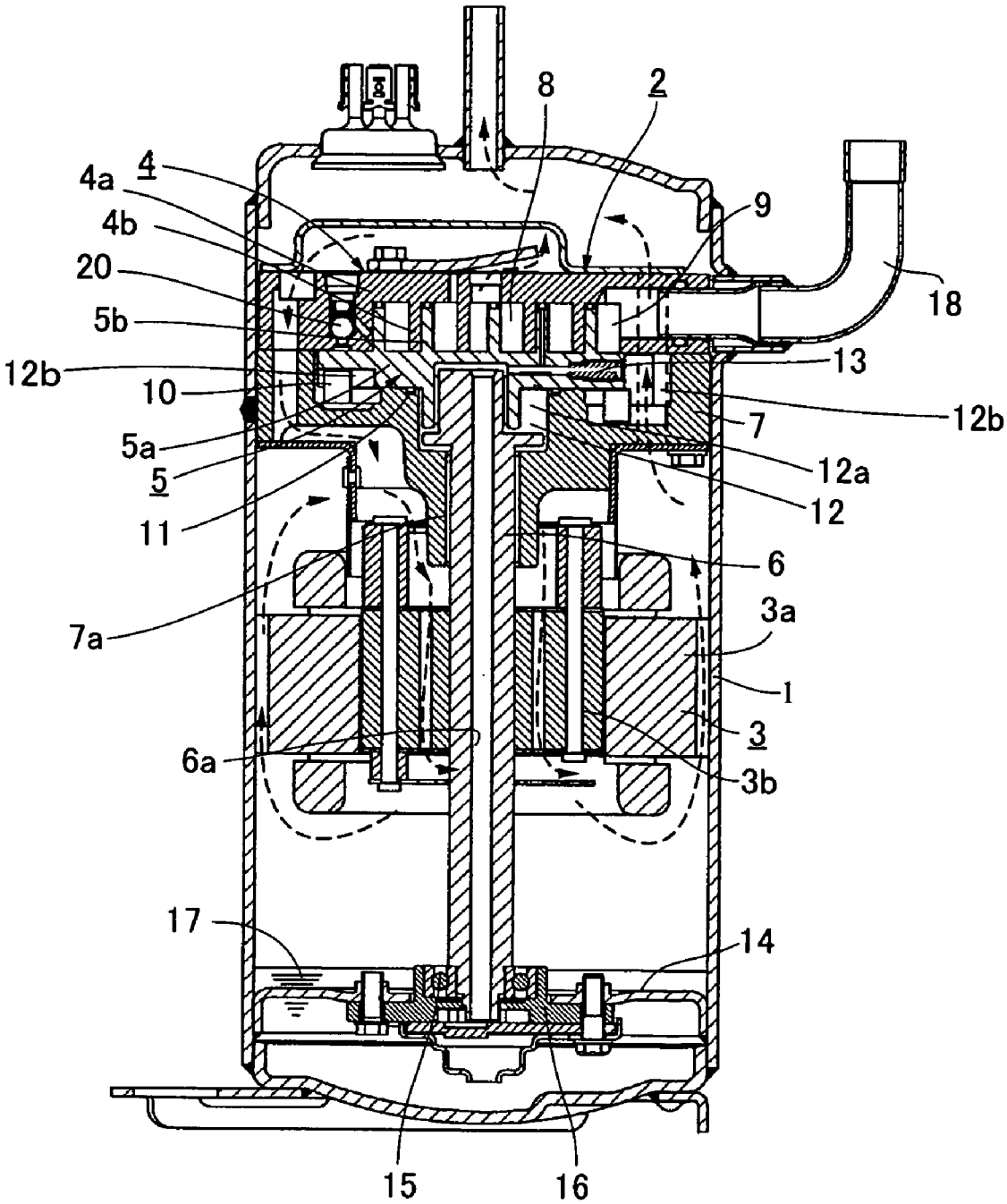
FIG. 1 is a vertical sectional view showing a scroll compressor of a first embodiment of the present invention.

FIG. 1 is a vertical sectional view of a scroll compressor according to a first embodiment of the present invention. A material to be compressed is refrigerant gas.

As shown in FIG. 1, the scroll compressor of the embodiment includes a main bearing member 7 of a crankshaft 6 fixed in a container 1 by welding or shrink fitting, a fixed scroll 4 fixed on the main bearing member 7 by means of a bolt, an orbiting scroll 5 combining with the fixed scroll 4, and a scroll compression mechanism 2 formed by sandwiching the orbiting scroll 5 between the main bearing member 7 and the fixed scroll 4. A rotation-restraint member 10 is provided between the orbiting scroll 5 and the main bearing member 7. The rotation-restraint member 10 comprises an Oldham ring, and prevents the orbiting scroll 5 from rotating and guides the orbiting scroll 5 such that the orbiting scroll 5 orbits. The orbiting scroll 5 is eccentrically driven by an eccentric portion provided on an upper end of the crankshaft 6, thereby allowing the orbiting scroll 5 to orbit.

A fixed scroll wrap 4*b* is provided on a fixed mirror plate 4*a* of the fixed scroll 4. An orbiting scroll wrap 5*b* is provided on an orbiting mirror plate 5*a* of the orbiting scroll 5. By orbiting the orbiting scroll 5 a compressed chamber 8 is formed by combining the fixed scroll wrap 4*b* and the orbiting scroll wrap 5*b* with each other. The compressed chamber 8 is moved from its outer peripheral side toward its central portion while reducing its volume, and utilizing this fact, refrigerant gas is sucked from a suction pipe 18 which is in communication with outside of the container 1 and from an outer peripheral suction space 9 of the fixed scroll 4, the refrigerant gas is compressed, and if the pressure of the refrigerant gas becomes equal to or higher than a predetermined pressure, the refrigerant gas is discharged into the container 1 from a discharge port formed in a central portion of the fixed scroll 4, and these operations are repeated.

A lower end of the crankshaft 6 reaches a lubricant oil reservoir 17 of a lower end of the container 1, and the lower end of the crankshaft 6 is supported by an auxiliary bearing member 15 and is stably rotated. The auxiliary bearing member 15 is mounted on an auxiliary bearing holding member 14 which is fixed in the container 1 by welding or shrink fitting. A motor 3 includes a stator 3*a* and a rotor 3*b*, and is located between the main bearing member 7 and the auxiliary bearing holding member 14 and is fixed to the container 1 by welding or shrink fitting. The rotor 3*b* is integrally coupled around the crankshaft 6. If the rotor 3*a* and the crankshaft 6 rotate, the orbiting scroll 5 orbits.

The orbiting scroll 5 is provided at its back surface with a back pressure chamber 12. The main bearing member 7 is provided with an annular groove, an annular seal 11 is disposed in the annular groove, and the back pressure chamber 12 is divided into two regions, i.e., an inner region 12*a* and an outer region 12*b* by the annular seal 11. High discharge pressure Pd is applied to the inner region 12*a*. Predetermined intermediate pressure Pm between the suction pressure Ps and the discharge pressure Pd is applied to the outer region 12*b*. Thrust is applied to the orbiting scroll 5 by the pressure in the back pressure chamber 12, the orbiting scroll 5 is stably pushed against the fixed scroll 4, thereby reducing leakage, and the orbiting scroll 5 stably orbits.

Next, concerning the lubricating operation of the scroll compressor of the embodiment, a lubricating path of the compression mechanism 2 will be explained. A positive-oil pump 16 is mounted on the auxiliary bearing holding member 14. The oil pump 16 is driven by a lower end of the crankshaft 6. Lubricant oil pumped up from the lubricant oil reservoir 17 by the oil pump 16 is supplied to various sliding portions of the compression mechanism 2 through a lubricant oil supply hole 6*a* penetrating the crankshaft 6. Most of the lubricant oil supplied to an upper end of the crankshaft 6 through the lubricant oil supply hole 6*a* lubricates an eccentric bearing and a main bearing 7*a* of the crankshaft 6 and then, flows out below the main bearing member 7 and finally returns to the lubricant oil reservoir 17. A portion of the lubricant oil supplied to the upper end of the crankshaft 6 flows to a passage and a narrowed portion 13 provided in the orbiting scroll 5, the lubricant oil is decompressed there and is supplied to the outer region 12*b* of the annular seal 11. A rotation-restraint member 10 is disposed in the outer region 12*b*, and the supplied lubricant oil lubricates the rotation-restraint member 10. As the lubricant oil is accumulated in the outer region 12*b*, the pressure in the outer region 12*b* rises. To maintain the pressure at constant level, a pressure adjusting mechanism 20 is disposed between the suction space 9 and the outer region 12*b* of the annular seal 11. If the pressure in the outer region 12*b* becomes higher than the back pressure $\Delta P$ (=Pm−Ps), the pressure adjusting mechanism 20 is operated, the lubricant oil in the outer region 12*b* is supplied to the suction space 9, and the pressure in the outer region 12*b* is maintained at substantially at constant level. The lubricant oil supplied to the suction space 9 enters the compressed chamber 8, functions as a seal for preventing the refrigerant gas from leaking from the compressed chamber 8 and also functions to lubricate the sliding surfaces of the fixed scroll 4 and the orbiting scroll 5.

Figure 2:
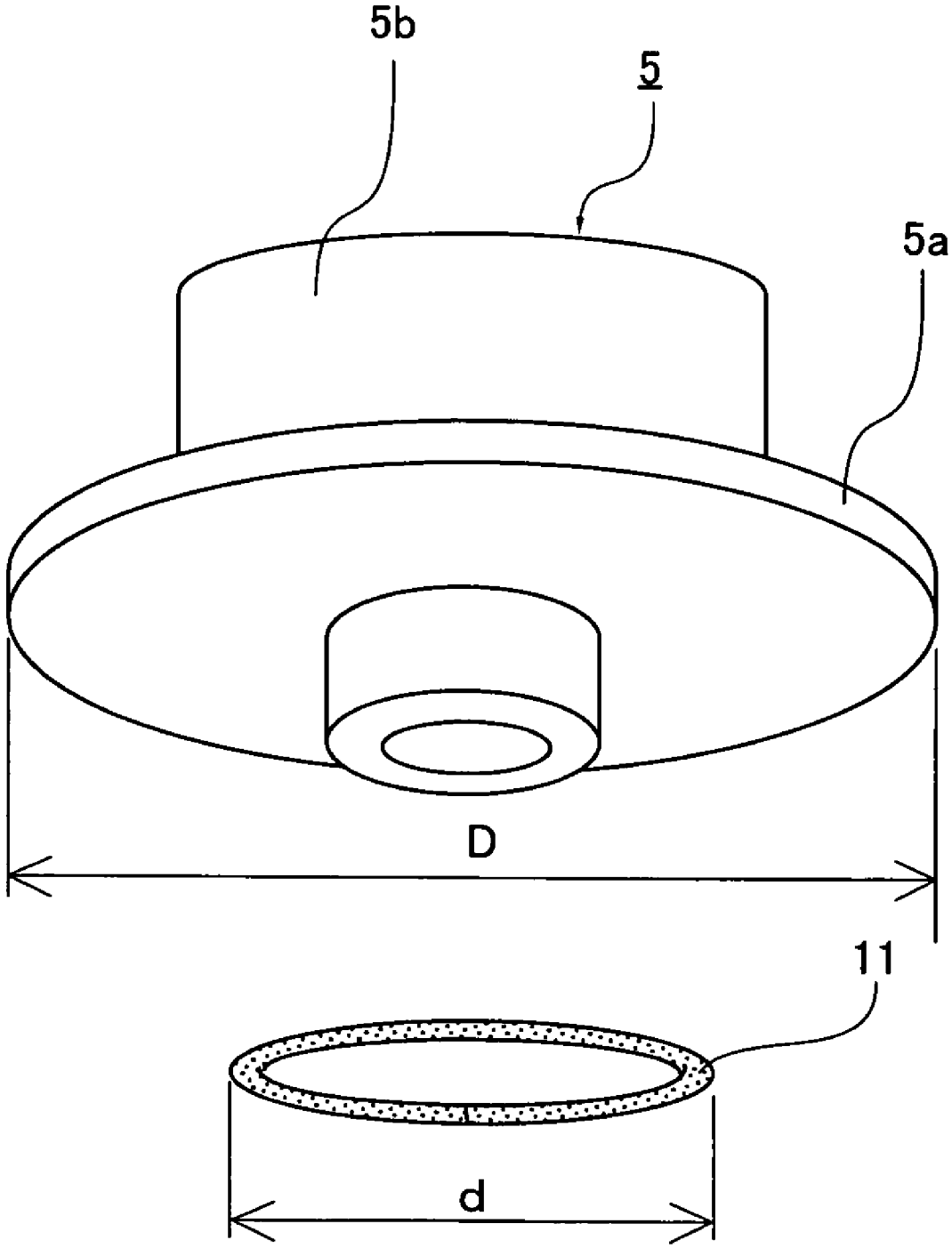
FIG. 2 is a partial perspective view showing an orbiting scroll and an annular seal of the scroll compressor shown in FIG. 1.

Next, the scroll compressor of the first embodiment will be explained in more detail using FIGS. 2 and 3. In the scroll compressor of the first embodiment, a relation of a ratio (d/D) of a diameter D of the orbiting mirror plate 5*a* of the orbiting scroll 5 and an outer diameter d of the annular seal 11, shown in FIG. 2, is set greater than 0.5. As shown in FIG. 2, the annular seal 11 is disposed on the opposite side of the orbiting scroll wrap 5*b* of the orbiting scroll 5, i.e., on the side of the back pressure chamber 12.

In a refrigeration cycle of an air conditioning system such as an air conditioner or a heat pump water heater, a pressure ratio Pd/Ps of the discharge pressure Pd and the suction pressure Ps is varied within a range of about 2 to 6 in accordance with operation conditions. FIG. 3 shows a case in which Pd is applied to the inner region 12*a* of the annular seal 11 in the back pressure chamber 12 of the orbiting scroll 5, and Ps is applied to the outer region 12*b*. More specifically, FIG. 3 shows a relation between the thrust force and the diameter ratio d/D in the case that the operation condition is varied, and thrust force is calculated from a pressure balance applied to the orbiting mirror plate 5*a* of the orbiting scroll 5.

Figure 3:
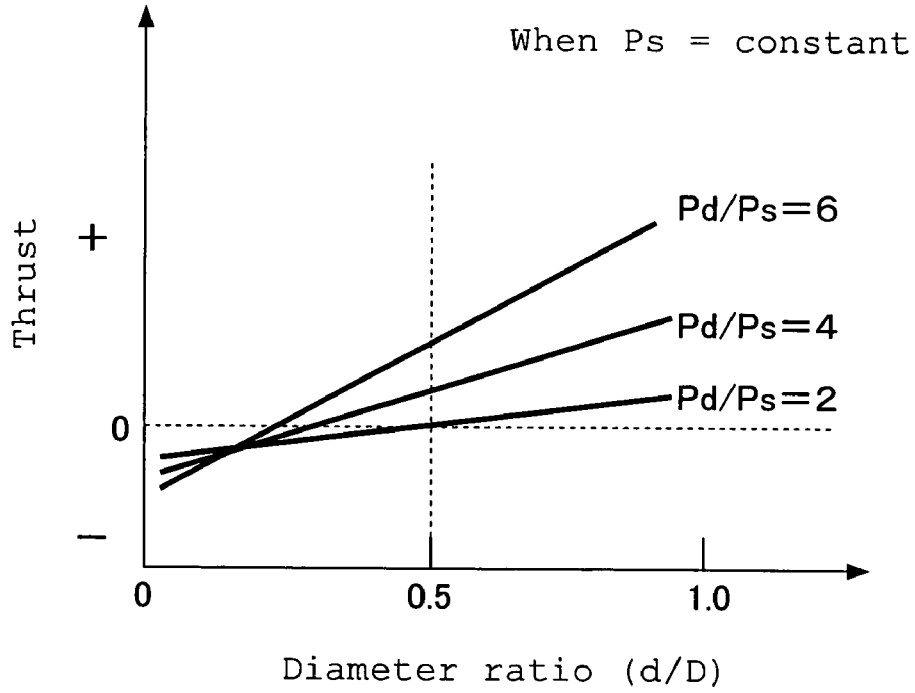
FIG. 3 is a diagram showing a relation between thrust force and a diameter ratio (d/D) of the scroll compressor shown in FIG. 1.

It can be found from the diagram of FIG. 3 that in order to bring the orbiting scroll 5 into contact and slide with the fixed scroll 4, it is only necessary that the thrust force is always plus (+) when the pressure ratio Pd/Ps is varied in the range of about 2 to 6 and thus, the outer diameter of the annular seal 11 should be set greater than about 0.5 times of the diameter of the orbiting mirror plate 5*a* of the orbiting scroll 5.

That is, if the diameter ratio d/D is set greater than 0.5, thrust force of plus (+) can always be obtained irrespective of the magnitude of the discharge pressure. Therefore, it is possible to bring the orbiting scroll 5 into contact and slide with the fixed scroll 4 only by the discharge pressure Pd applied to the inner region 12*a* of the annular seal 11. With this, the intermediate pressure Pm applied to the outer region 12*b* of the annular seal 11 can be set to the same value as the suction pressure Ps or a value close to the suction pressure Ps. Therefore, in the scroll compressor of the first embodiment, the pressure adjusting mechanism 20 is set such that the scroll compressor is operated even when the back pressure ΔP is about 0.

With the structure of the compression mechanism 2 of the embodiment, when the compression mechanism 2 is started, lubricant oil supplied to the outer region 12*b* of the annular seal 11 is supplied to the suction space 9 without a time lag. Therefore, at the initial stage of the starting operation, even if a large amount of refrigerant liquid is sucked into the suction space 9 and the refrigerant liquid washes lubricant oil away, since new lubricant oil is supplied to the suction space 9 immediately, there is a large effect that the sliding surface is not seized up.

Second Embodiment

Next, a scroll compressor of a second embodiment of the invention will be explained. In the second embodiment, the back pressure ΔP (=Pm−Ps) applied to the outer region 12*b* of the annular seal 11 shown in the scroll compressor of the first embodiment in FIG. 1 is set in the following manner. Constituent members having the same functions as those of the scroll compressor of the first embodiment are designated with the same reference symbols, and explanation thereof will be omitted.

Lubricant oil flows into the outer region 12*b* of the annular seal 11 from the inner region 12*a*, and the pressure in the outer region 12*b* rises, but as a set pressure of the back pressure is lower, the pressure in the outer region 12*b* reaches that value within a short time. When the pressure in the outer region 12*b* of the annular seal 11 rises to the set back pressure, the lubricant oil is supplied to the suction space 9 of the compression mechanism 2. Therefore, in the second embodiment, the value of the back pressure ΔP is defined by the pressure adjusting mechanism 20 embedded in the fixed scroll 4 such that a ratio (ΔP/Po) of the back pressure ΔP and saturation vapor pressure Po when the temperature of a refrigerant to be used is at 0 (C becomes substantially a constant value and 0.2 or lower. That is, by setting the set back pressure of the outer region 12*b* small (0.2((P/Po(0), lubricant oil is immediately supplied to the suction space 9 at the time of start. That is, there is an effect that the supply delay of lubricant oil to the suction space 9 becomes smaller, and even if refrigerant liquid is sucked into the suction space from the initial stage of starting operation, the sliding surface is not seized up.

Figure 4:
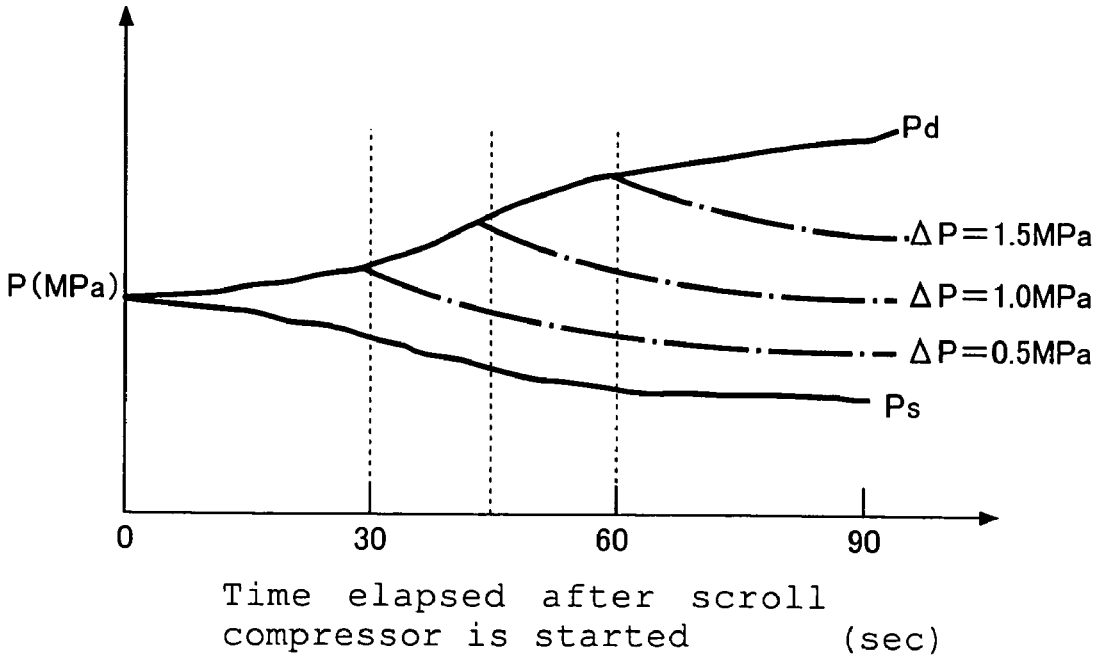
FIG. 4 is a diagram showing time after a scroll compressor of a second embodiment of the invention is started, and pressure variation thereof.
Figure 5:
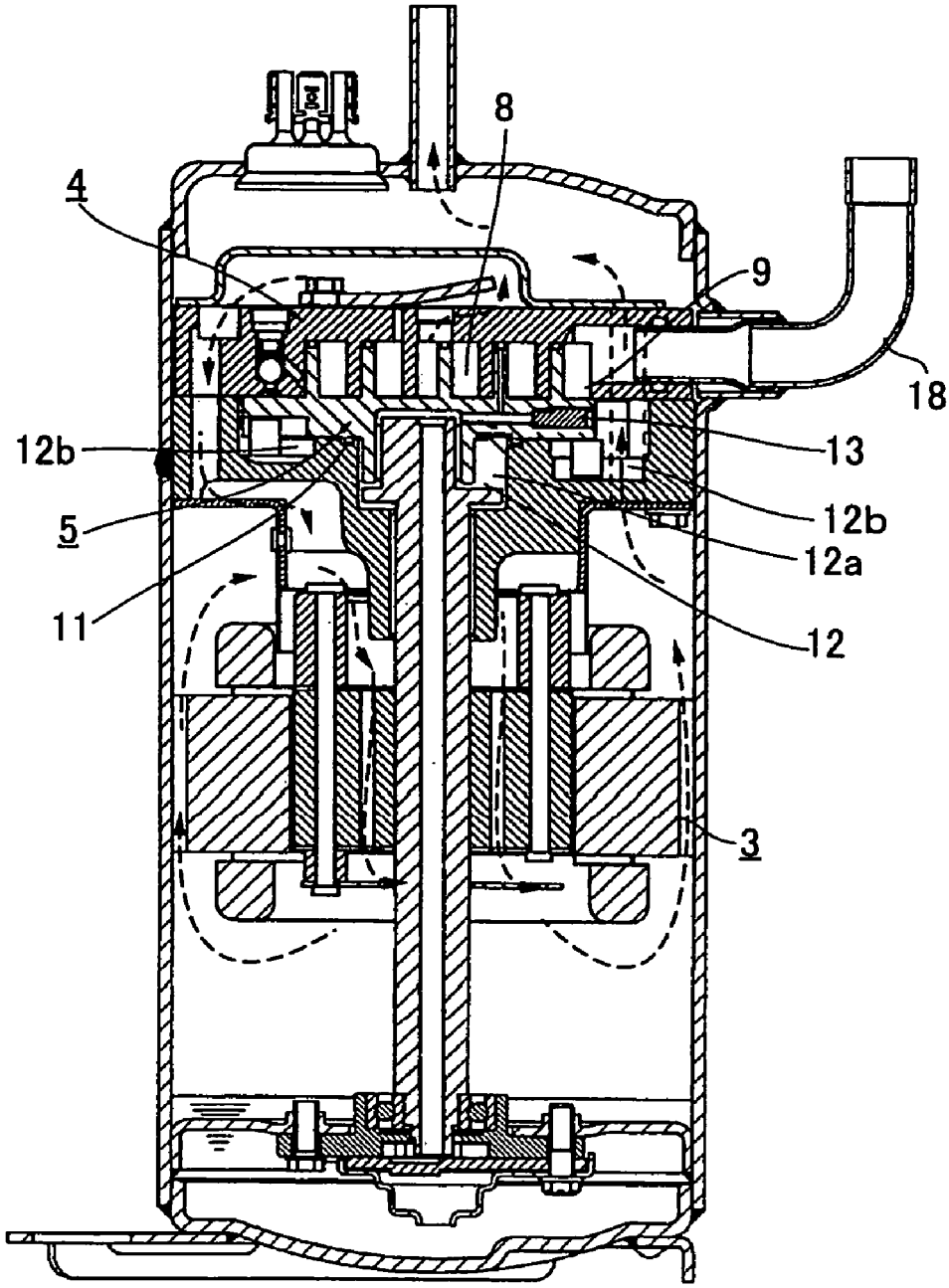
Fig. 5 (Prior Art)
FIG. 5 is a vertical sectional view showing a conventional scroll compressor.

FIG. 4 is a graph showing variation with time of suction pressure Ps, discharge pressure Pd and pressure (back pressure (P) of the outer region 12*b* of the annular seal 11 at the time of start of the scroll compressor using CO2 refrigerant. That is, using three CO2 scroll compressors, settings of the pressure adjusting mechanism 20 are varied, and pressure (P in the outer region 12*b* of the annular seal 11 is set to three different values, i.e., 0.5 MPa, 1.0 MPa and 1.5 MPa for example. FIG. 4 shows a result of experiment evaluation.

In FIG. 4 showing variation of back pressure with time, the back pressure reaches 0.5 Mpa after about 30 seconds from the start of operation, reaches 1.0 MPa after about 45 seconds, and reaches 1.5 MPa after about 60 seconds. In other words, when the back pressure (P is set to 0.5 MPa, lubricant oil is supplied to the suction space 9 after about 30 seconds, but when the back pressure (P is set to 1.0 MPa, the lubricant oil is not supplied to the suction space 9 until about 45 seconds are elapsed after the start of operation.

As a result of this starting test, in scroll compressors in which the back pressure (P was respectively set to 1.0 MOPa and 1.5 MPa, seizure was found on the sliding surfaces, i.e., mirror plates 4*a* and 5*a* of the orbiting scroll 5 and fixed scroll 4. However, in a compressor in which the back pressure (P was set to 0.5 MPa, seizure was not found.

When the refrigerant is CO2, saturation vapor pressure Po at 0(C is 3.5 MPa (abs), and when the set back pressure (P is 0.5 MPa, a ratio ((P/Po) of (P and Po is 0.143.

From these experiments, it could be found that in the scroll compressor of the second embodiment, by setting (P was set such that the value (P/Po became 0.2 or lower, lubricant oil could be supplied to the suction space swiftly at the time of start, sliding flaw or seizure could be prevented, and the reliability could be enhanced.

When the back pressure (P is set small also (when CO2 refrigerant is used and (P is set to 0.5 MPa), in order to efficiently operate the scroll compressor stably under various conditions such as a rating operation condition, it is preferable that the outer diameter d of the annular seal 11 is set to 0.5 or more of the diameter D of the orbiting mirror plate 5*a* of the orbiting scroll 5 as described in the first embodiment.

It was confirmed that when the back pressure (P was set small, even if a refrigerant including a large amount of refrigerant liquid (i.e., refrigerant having dryness parameter of 0.5 or lower) is sucked into the suction space 9, seizure was not generated on the sliding surfaces of the orbiting scroll 5 and the fixed scroll 4.

As apparent from the above explanation, in the present invention, the ratio (d/D) of the diameter D of the orbiting mirror plate of the orbiting scroll and the outer diameter of the annular seal is set 0.5 or greater. With this, it is only necessary that the pressure Pm applied to the outer region of the annular seal is set to the same value as the suction pressure Ps or a value close to the suction pressure Ps. As a result, when the compressor is started, lubricant oil supplied to the outer region of the annular seal is supplied to the suction space substantially simultaneously. Therefore, the supply delay of lubricant oil is eliminated, and even if refrigerant liquid is sucked into the suction space from the initial stage of the start, there is an effect that the sliding surface is not seized up.

Further, in the present invention, the back pressure (P is set small so that the ratio ((P/Po) of the back pressure (P (=Pm−Ps) applied to the outer region of the annular seal and the saturation vapor pressure Po of the refrigerant gas at 0(C is substantially a constant value and 0.2 or lower. With this, the pressure in the outer region of the annular seal reaches the set value within a short time, lubricant oil is also supplied to the suction space of the compressor mechanism swiftly and thus, the supply delay of the lubricant oil to the suction space is reduced. Even if a refrigerant having dryness parameter of 0.5 or less is sucked into the suction space from the initial stage of start, there is an effect that the sliding surfaces are not seized up.

Further, according to the invention, even if a refrigerant sucked into the suction space includes refrigerant liquid having dryness parameter of 0.5 or less, since the lubricant oil can be supplied swiftly at the time of start in the first or second embodiment, the reliability of the scroll compressor can be enhanced. When CO2 is used as the refrigerant, since an absolute value of the pressure of CO2 itself is high, the sliding surface is prone to be seizured correspondingly, but if the back pressure (P of the outer region of the annular seal is set small, the back pressure rises to the set value within a short time. With this, the lubricant oil is swiftly supplied to the suction space and thus, the seizure of the sliding portion can be prevented.

INDUSTRIAL APPLICABILITY

According to the present invention, as described above, it is possible to provide a reliable scroll compressor capable of preventing the supply delay at the time of start of the scroll compressor.

The invention claimed is:

1. A scroll compressor wherein a fixed scroll having a fixed scroll wrap on a fixed mirror plate and an orbiting scroll having an orbiting scroll wrap on an orbiting mirror plate are combined with each other to form a plurality of compressed chambers, a back pressure chamber is provided on a surface on the opposite side from said orbiting scroll wrap surface of said orbiting scroll, a suction space is formed in an outer periphery of said fixed scroll, said back pressure chamber is divided by an annular seal into an inner region and an outer region, a lubricant oil in a discharge pressure state is supplied to said inner region of said annular seal, a portion of the lubricant oil is decompressed at a narrowed portion and supplied to said outer region, the lubricant oil in the outer region is supplied to said suction space, pressure in said inner region is set to discharge pressure Pd, pressure in said outer region is set to a predetermined pressure Pm between a suction pressure Ps and a discharge pressure Pd, thrust force is applied to a back surface of said orbiting scroll, thereby bringing said orbiting scroll into contact with said fixed scroll, rotation of said orbiting scroll is restrained by a rotation-restraint member, said orbiting scroll is allowed to orbit, thereby moving said compressed chamber toward a center of scroll while reducing its volume, refrigerant gas is sucked from the suction space into said compressed chamber and compressed, a pressure ratio (Pd/Ps) between the discharge pressure Pd and the suction pressure Ps is set to 2 to 6, and a ratio (d/D) of a diameter D of said orbiting mirror plate of said orbiting scroll and an outer diameter d of said annular seal is set greater than 0.5.

2. The scroll compressor according to claim 1, wherein a back pressure ΔP (=Pm−Ps) applied to said outer region divided by said annular seal is set such that a ratio (ΔP/Po) of the back pressure ΔP and a saturation vapor pressure Po when said refrigerant gas is at 0° C. is substantially a constant value and 0.2 or lower.

3. The scroll compressor according to claim 2, wherein said refrigerant gas sucked into said suction space includes liquid refrigerant having dryness parameter of 0.5 or less.

4. The scroll compressor according to claim 2, wherein carbon dioxide is used as said refrigerant.

5. The scroll compressor according to claim 1, wherein said refrigerant gas sucked into said suction space includes liquid refrigerant having dryness parameter of 0.5 or less.

6. The scroll compressor according to claim 1, wherein carbon dioxide is used as said refrigerant.

* * * * *